US007392888B2

(12) United States Patent
Lai

(10) Patent No.: US 7,392,888 B2
(45) Date of Patent: Jul. 1, 2008

(54) TRAVEL BAG

(76) Inventor: Allen Lai, No. 5, Lane 210, Hoping Rd., Tantze Hsiang, Taichung County (TW)

( * ) Notice: Subject to any disclaimer, the term of this patent is extended or adjusted under 35 U.S.C. 154(b) by 749 days.

(21) Appl. No.: 11/023,460

(22) Filed: Dec. 29, 2004

(65) Prior Publication Data

US 2006/0137951 A1 Jun. 29, 2006

(51) Int. Cl.
*A45C 13/26* (2006.01)

(52) U.S. Cl. ..... 190/126; 190/124; 190/127; 190/40; 190/115

(58) Field of Classification Search ..... 190/18 A, 190/115, 124, 126, 127, 40, 37
See application file for complete search history.

(56) References Cited

U.S. PATENT DOCUMENTS 5,794,744 A * 8/1998 Lin ..... 190/18 A
6,119,835 A * 9/2000 Lin ..... 190/127
6,148,973 A * 11/2000 Chang ..... 190/127
6,220,412 B1 * 4/2001 Lin ..... 190/127
6,283,261 B1 * 9/2001 Sher ..... 190/122
6,612,413 B2 * 9/2003 Kuwayama ..... 190/127
6,651,792 B1 * 11/2003 Kuwayama ..... 190/24
6,892,434 B2 * 5/2005 Fenton et al. ..... 29/469

* cited by examiner

*Primary Examiner*—Tri M Mai
(74) *Attorney, Agent, or Firm*—Rosenberg, Klein & Lee

(57) ABSTRACT

A travel bag is disclosed to include two rigid side panels symmetrically disposed at two opposite lateral sides, a rigid top panel disposed at the top side, a rigid bottom panel disposed at the bottom side, a retractable handle provided at the back side, and a cover provided at the front side, a reinforcing wire fastened to the periphery of the side panels, the top panel and the bottom panel to bind the side panels, the top panel and the bottom panel tightly together, and two rubber packing strips and a cloth covering provided between side panels to cause a sense of beauty.

2 Claims, 4 Drawing Sheets

TRAVEL BAG

BACKGROUND OF THE INVENTION

1. Field of the Invention

The present invention relates to a travel bag and more particularly, to a lightweight, durable, impact resistant travel bag.

2. Description of the Related Art

FIG. 1 shows a conventional travel bag. This structure of travel bag comprises a body 10, which comprises a rectangular plastic open frame 11 equipped with a retractable handle 13 and wheels 12, a cloth covering 14 wrapping the body 10, a cover 15 hinged to the cloth covering 14, and a zipper 16 fastened to the cloth covering 14 and the cover 15 for opening/closing the cover 15.

This structure of travel bag has drawbacks as follows:

1. The rectangular plastic open frame 11 is not collapsible and requires much storage space. In factory, much storage space shall be spared for inventory control.

2. The rectangular plastic open frame 11 has only the four peripheral sides to resist impact, and the corner area around the open back side tends to be deformed or damaged accidentally, i.e., the travel bag has low impact resisting power.

3. The cloth covering 14 gives little appearance variation to attract consumers.

SUMMARY OF THE INVENTION

The present invention has been accomplished under the circumstances in view. It is the main object of the present invention to provide a travel bag, which is lightweight, durable, and impact resistant.

According to one aspect of the present invention, the travel bag is comprised of two rigid side panels symmetrically disposed at two opposite lateral sides, a rigid top panel disposed at the top side, a rigid bottom panel disposed at the bottom side, a retractable handle provided at the back side, and a cover provided at the front side. Therefore, the top, bottom, left, right, front and back sides of the travel bag are well protected against impact. According to another aspect of the present invention, a reinforcing wire is fastened to the periphery of the side panels, the top panel and the bottom panel to bind the side panels, the top panel and the bottom panel tightly together. According to still another aspect of the present invention, rubber packing strips and cloth covering are provided to cause a sense of beauty.

DETAILED DESCRIPTION OF THE PREFERRED EMBODIMENT

Figure 1:
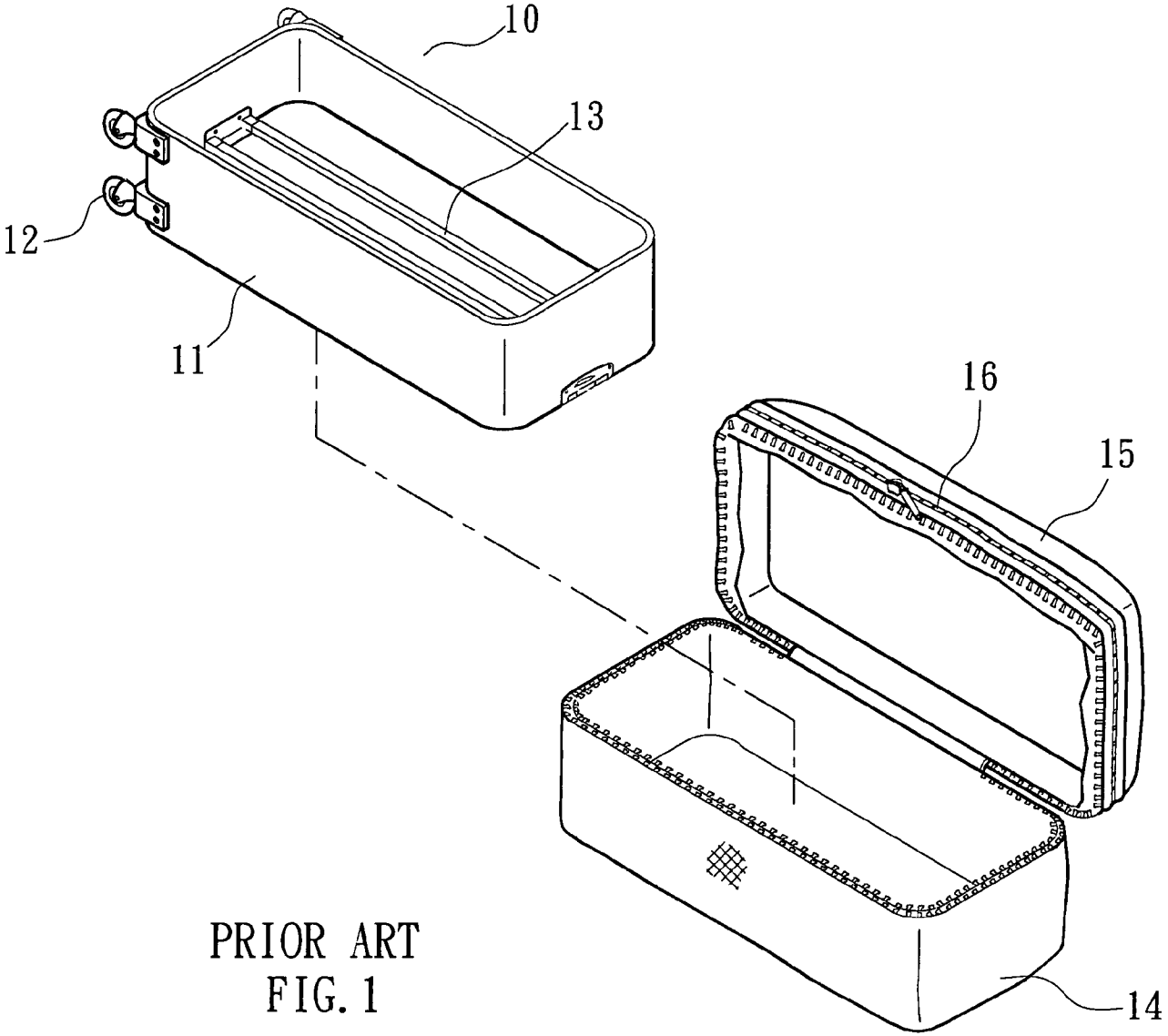
PRIOR ART FIG. 1
FIG. 1 is an exploded view of a travel bag according to the prior art.
Figure 2:
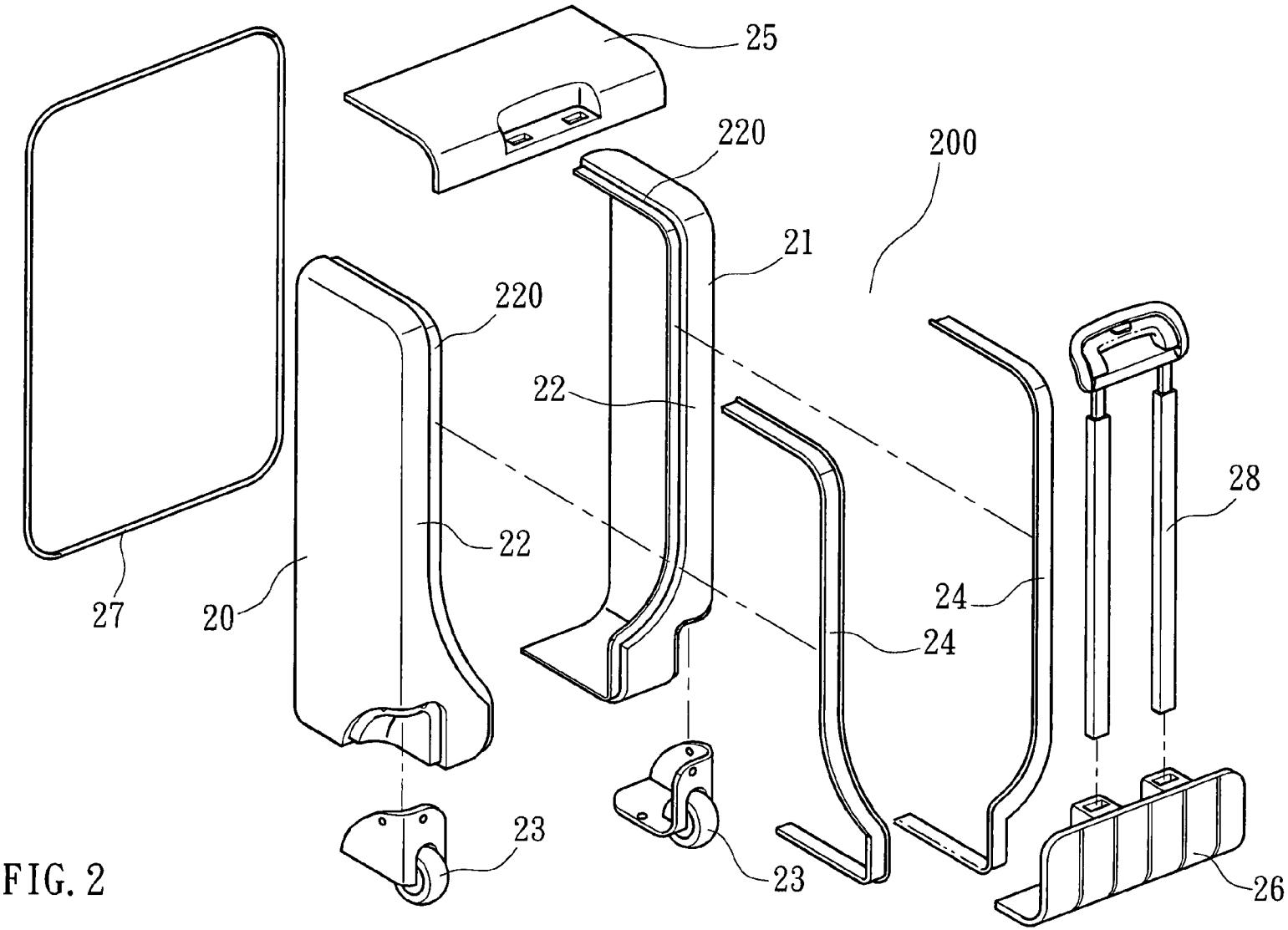
FIG. 2 is an exploded view of a travel bag according to the present invention.
Figure 3:
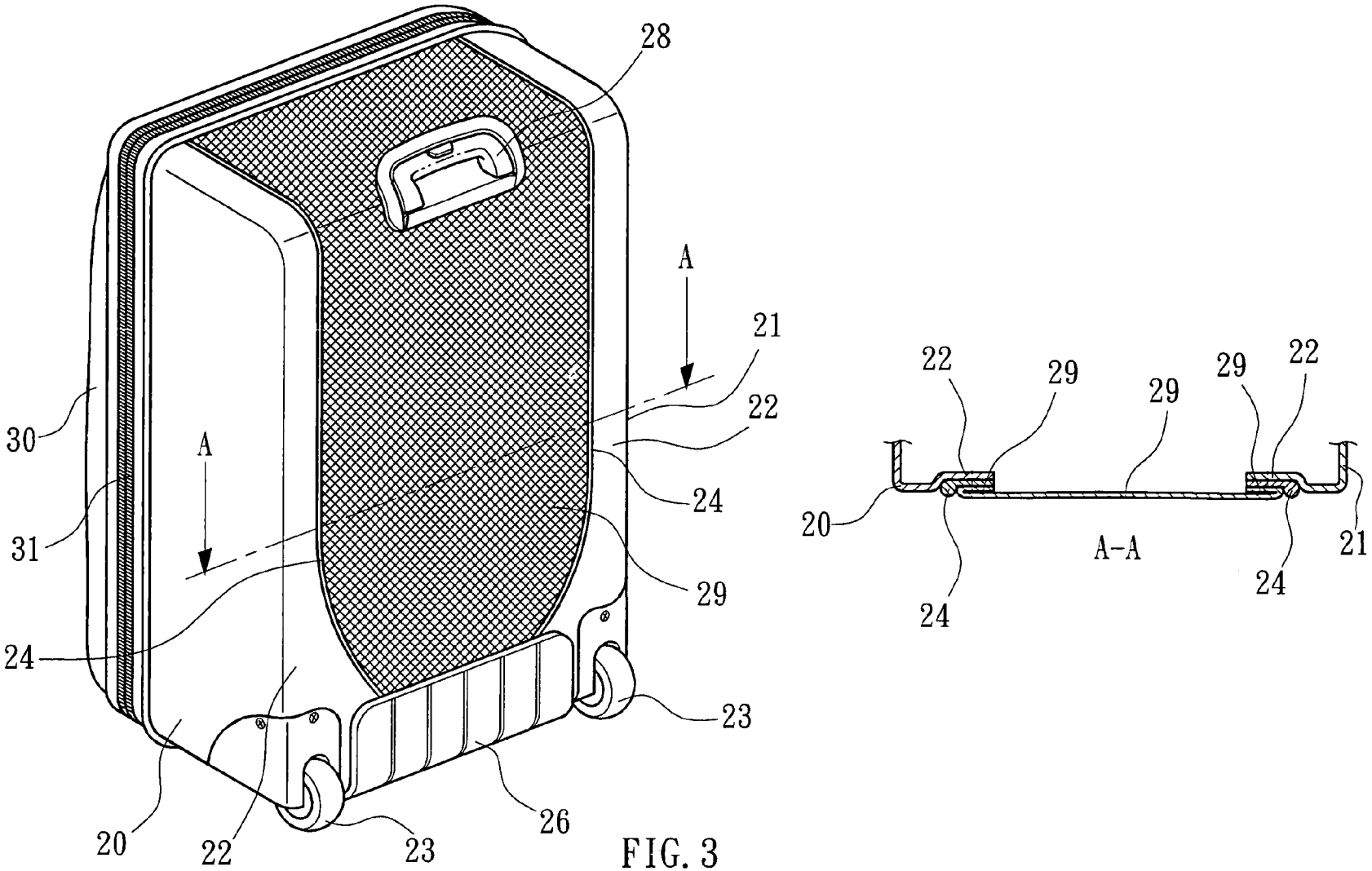
FIG. 3 is an assembly view and A-A sectional view of the travel bag according to the present invention.

Referring to FIGS. 2 and 3, a travel bag 200 is shown comprising two symmetrical side panels 20,21, two rubber packing strips 24, a top panel 25, a bottom panel 26, and a reinforcing wire 27.

The two side panels 20,21 are respectively molded from rigid plastics, each having a back extension 22 and a groove 220 extending along the length of the back extension 22. Further, the side panels 20,21 each have a bottom side equipped with a respective wheel 23.

The top panel 25 and the bottom panel 26 are respectively molded from rigid plastics. The two rubber packing strips 24 are respectively fastened to the grooves 220 at the back extensions 22 of the side panels 20,21. The top panel 25 is pressed on the two rubber packing strips 24 against the back extensions 22 of the side panels 20,21 at the top side. A cloth covering 29 is covered on the top panel 25 and the rubber packing strips 24. The bottom panel 28 is fastened to the side panels 20,21 at the bottom side and pressed on the bottom edge of the cloth covering 29. By means of stitches, the side panels 20,21, the rubber packing strips 24, the top panel 25, the bottom panel 26 and the cloth covering 29 are fastened together. Thereafter, a retractable handle 28 is fastened to the top panel 25 and the bottom panel 26. The reinforcing wire 27 is fastened to the periphery of the side panels 20,21, the top panel 25 and the bottom panel 26 to bind the side panels 20,21, the top panel 25 and the bottom panel 26 together. At final, a cover 30 is fastened with a zipper 31 to the side panels 20,21 and the top panel 25.

The stitching of the present invention is as shown in FIG. 3 A-A. As illustrated, the cloth covering 29, the rubber packing strips 24, the top panel 25 and the bottom panel 26 are overlapped on one another and stitched together, and then turned inside out to keep the stitched area from sight with the rubber packing strips 24 exposed to the outside to show a sense of beauty.

According to the present invention, the side panels 20,21, the top panel 25 and the bottom panel 26 are respectively molded from ABS for the advantages of high durability and impact resistance. The reinforcing wire 27 is a steel wire that provides a strong binding force to bind the side panels 20,21, the top panel 25 and the bottom panel 26 tightly together.

As indicated above, the invention has the following advantages:

1. The top, bottom and two opposite lateral sides of the travel bag are protected by the rigid side panels 20,21, the rigid top panel 25 and the rigid bottom panel 26 against impact.

2. The side panels 20,21 each have a back extension 22 that greatly reinforces the structural strength of the respective side panel.

3. The reinforcing wire 27 binds the side panels 20,21, the top panel 25 and the bottom panel 26 tightly together, thereby reinforcing the structural strength of the travel bag.

4. The rubber packing strips 24 cause a linear sense of beauty and reinforce the impact strength of the side panels 20,21.

5. The elevational difference between the side panels 20,21 and the cloth covering 29 causes a sense of beauty.

6. As shown in FIG. 2, the parts of the travel bag before assembly can be arranged together to save storage space, facilitating inventory control.

7. The side panels 20,21, the top panel 25 and the bottom panel 26 can be prepared in different colors to provide a color variation.

Figure 4:
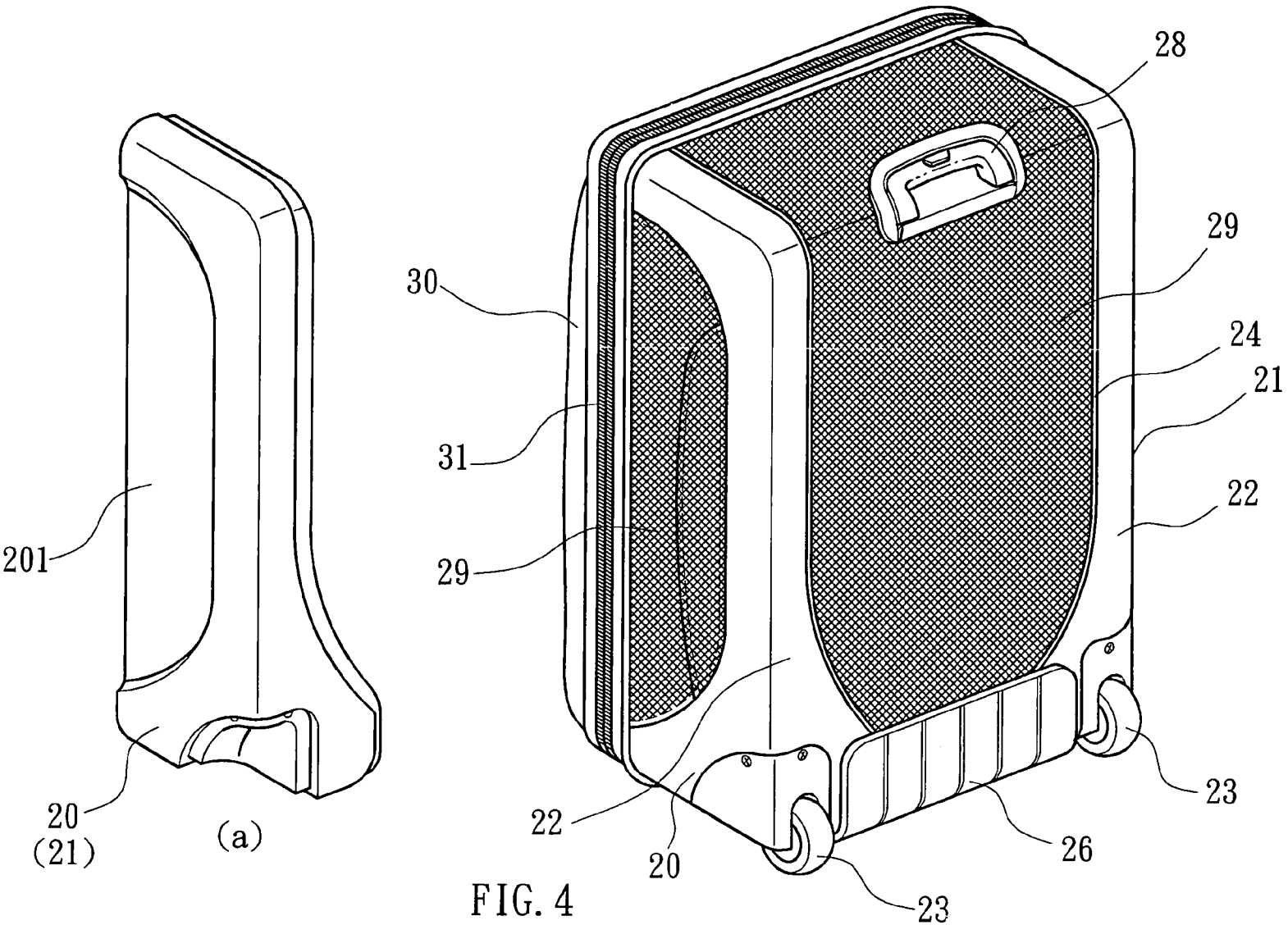
FIG. 4 shows one alternate form of the travel bag and (a) is the elevational view of one side panel of the alternate form of the travel bag according to the present invention.

FIG. 4 shows an alternate form of the present invention. According to this embodiment, the side panels 20,21 each have an outer recess 201 covered with a cloth covering 29.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A travel bag comprising:

two side panels respectively molded from rigid plastics and symmetrically disposed at two sides, said side panels each having a back extension and a groove extending along the length of said back extension;

two rubber packing strips respectively fastened to the grooves at the back extensions of said side panels;

a top panel molded from rigid plastics and pressed on said two rubber packing strips against the back extensions of said side panels at atop side;

a cloth covering covered on said top panel and said rubber packing strips;

a bottom panel molded from rigid plastics and fastened to said side panels at a bottom side and pressed on a bottom edge of said cloth covering;

a retractable handle fastened to said top panel and said bottom panel;

a reinforcing wire fastened to the periphery of said side panels, said top panel and said bottom panel to bind said side panels, said top panel and said bottom panel together; and a cover fastened with a zipper to said side panels and said top panel.

2. The travel bag as claimed in claim 1, wherein said side panels each have an outer recess covered with a cloth covering.

* * * * *